United States Patent [19]

Marton

[11] Patent Number: 4,841,122

[45] Date of Patent: Jun. 20, 1989

[54] HUMIDIFIER HAVING A HEATING CHAMBER WITH A CONTINUOUSLY OPEN DRAIN AND FLUSHING OUTLET

[75] Inventor: Lewis Marton, Randwick, Australia

[73] Assignee: Atlas Air (Australia) Pty, Limited, New South Wales, Australia

[21] Appl. No.: 948,408

[22] Filed: Dec. 30, 1986

Related U.S. Application Data

[63] Continuation of Ser. No. 706,265, Feb. 27, 1985, abandoned.

[30] Foreign Application Priority Data

Mar. 2, 1984 [AU] Australia ..... PG 3893

[51] Int. Cl.[4] ..... H05B 1/02; H05B 3/60; F22B 1/30

[52] U.S. Cl. ..... 219/273; 219/284; 219/288; 219/295

[58] Field of Search ..... 219/271–276, 219/284–295

[56] References Cited

U.S. PATENT DOCUMENTS

| | | | |
|---|---|---|---|
| 2,180,445 | 11/1939 | Vickery | 219/294 |
| 2,421,311 | 5/1947 | Binnington | 219/287 |
| 3,584,193 | 6/1971 | Badertscher | 219/362 X |
| 3,643,930 | 2/1972 | Schulze | 219/273 X |
| 3,670,141 | 6/1972 | Dines | 219/271 |
| 3,682,141 | 8/1972 | Johansen | 219/273 X |
| 3,761,679 | 9/1973 | Dall | 219/295 X |
| 3,780,261 | 12/1973 | Eaton-Williams | 219/295 X |
| 3,937,920 | 2/1976 | Gumdacker et al. | 219/273 X |
| 3,987,133 | 10/1976 | Andra | 219/272 X |
| 4,146,775 | 3/1979 | Kirchner et al. | 219/295 |
| 4,196,341 | 4/1980 | Williams | 219/295 |
| 4,262,191 | 4/1981 | Lepper et al. | 219/295 X |
| 4,347,430 | 8/1982 | Howard-Leicester | 219/295 |
| 4,382,173 | 5/1983 | Howard-Leicester | 219/295 |

FOREIGN PATENT DOCUMENTS

| | | | |
|---|---|---|---|
| 1271282 | 6/1968 | Fed. Rep. of Germany | 219/286 |
| 2279448 | 7/1974 | France | 219/295 |
| 122148 | 5/1971 | Norway | 219/293 |

*Primary Examiner*—Anthony Bartis
*Attorney, Agent, or Firm*—Bacon & Thomas

[57] ABSTRACT

A humidifier has an improved bottle wherein a continuously open drain outlet is located at the lower extremity of the bottle, a drain pipe being connected to the drain outlet and extending up the side of the bottle such that the upper end of the drain pipe establishes the static water level in the humidifier chamber. Electrodes extend vertically within the chamber such that current passes between the electrodes, via water in the chamber, to heat the water. The impurity level of the water in the chamber is monitored and when the impurity level reaches a predetermined value the chamber is flushed by opening a water inlet valve for a period of time. An electrical contact is provided to detect a high water level and when the water level drops below the high water level such that the contact continuously senses the absence of water for a fixed period of time, the inlet valve is opened until the high water level contact once again senses the water.

7 Claims, 3 Drawing Sheets

HUMIDIFIER HAVING A HEATING CHAMBER WITH A CONTINUOUSLY OPEN DRAIN AND FLUSHING OUTLET

This application is a continuation of application Ser. No. 706,265 filed on Feb. 27, 1985, now abandoned.

The present invention relates to improvements in humidifiers of the type used for raising atmospheric humidity in airconditioned areas such as computer rooms.

Airconditioning units generally have the effect of lowering the humidity of an area in which they operate and, while this is not always undesirable, it can lead to problems in areas in which electronic equipment is operating, due to the generation of static charges.

When humidity falls below certain levels, the ability of air to discharge static charges is diminished and therefore larger charges can accumulate on items of equipment under these conditions. However, many electronic devices are sensitive to large electric charges and can be destroyed or at least caused to malfunction by the presence of large static charges.

To overcome the problems associated with static charges, humidifiers are provided in areas such as computer rooms to ensure that the humidity is kept at a level which will prevent any significant build up of static charges.

Humidifiers generally comprise a water heating chamber in which a heating element or a plurality of electrodes are provided to heat the water. The chamber also has a steam outlet and a port for supplying water to the chamber, the supply of water being controlled by an inlet valve.

Heating elements have the disadvantage that they will burn out if they are not fully immersed in water, whereas electrode heaters, which comprise a plurality of electrodes inserted into the water, will only conduct current while they are immersed, the current carried being proportional to the amount of electrode immersed and for this reason, electrode heaters are preferred.

Because water enters the chamber and is then boiled off, any impurities in the water will remain in the chamber and therefore it is necessary to flush the chamber from time to time, the frequency being dependant upon the impurity content of the water supply. Flushing is particularly important with electrode heaters where the current carried by the water increases with the impurity content.

Flushing is typically accomplished by providing a drain valve, which is also connected to the water inlet port such that when the chamber is charged with water, the inlet valve closed and the drain valve opened, the charge of water flows out of the heating chamber, carrying some of the accumulated impurities with it. However, as the impurities must flow through the drain valve, this valve will eventually become blocked and cease to work efficiently, and also some of the impurities will remain in the inlet port and be carried back into the chamber with the next charge of water.

It is possible to protect the drain valve by fitting a screen to block the passage of larger particles, however, this defeats the purpose of having a drain, as the larger particles are left to accumulate in the chamber.

The present invention consists of a humidifier having a bottle, comprising a substantially closed heating chamber, a water inlet, a steam outlet located towards the top of the heating chamber, a port in said chamber adapted to accommodate connections to water heating means locatable within the chamber, a continuously open drain and flushing outlet located at the lower extremity of the chamber and a drain pipe communicating with said outlet and extending up the outside of the chamber, the upper end of the pipe defining a maximum water level in the chamber under static conditions.

The humidifier of the present invention can employ either electric heating elements or electrodes to provide heating of the water and the bottle is preferably adapted to accept a water level sensing probe.

Typically, the bottle used in the humidifier of the present invention will be moulded from plastics material and preferably by the blow moulding process.

According to the present invention the humidifier may also include:

- a water inlet valve and
- a pair of electrodes connected to a source of electrical power and adapted to be at least partially submerged by water when the humidifier is in use. The humidifier may have
- current sensing means to measure current flowing through said electrodes, and
- flushing control means to open said inlet valve for a predetermined time when the current through the electrodes reaches a predetermined value such that, while the inlet valve is open, water flows through the chamber and out of the drain and flushing outlet.

Embodiments of the invention will now be described, by way of example, with reference to the accompanying drawings in which.

Figure 3:
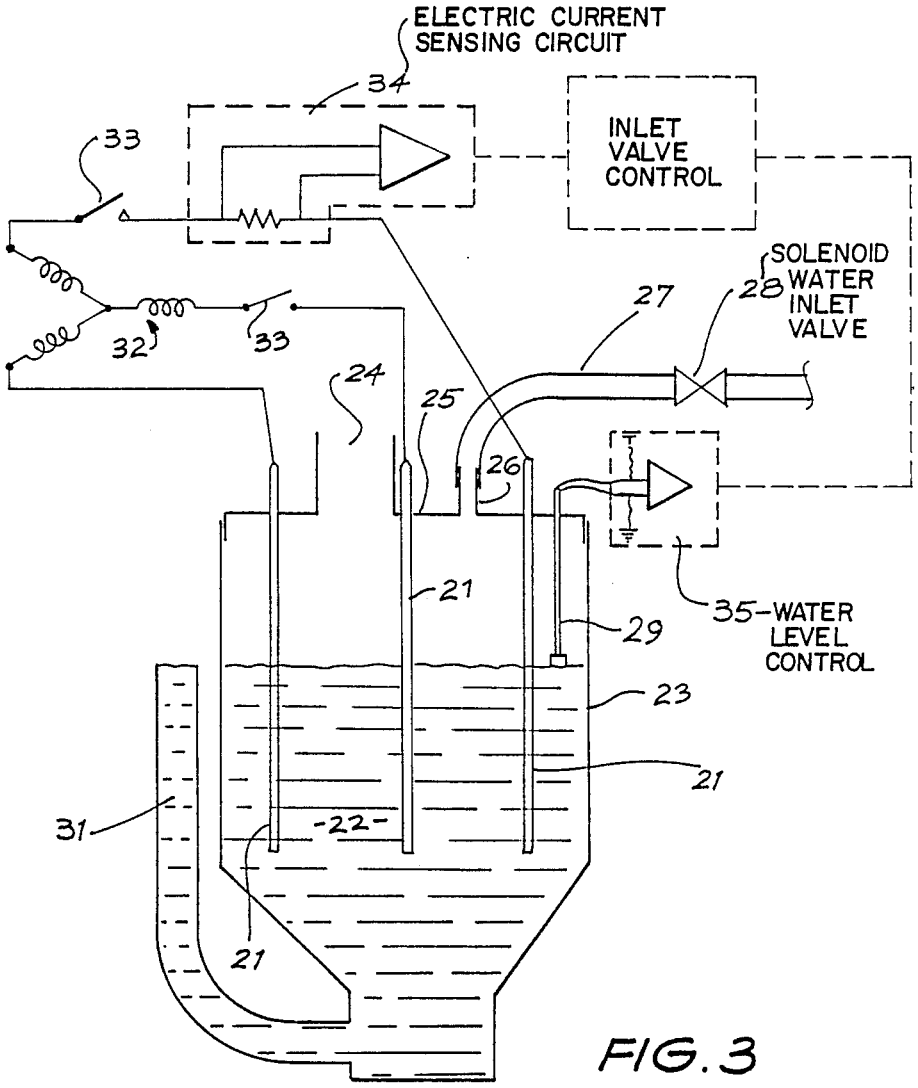
Figure 4:
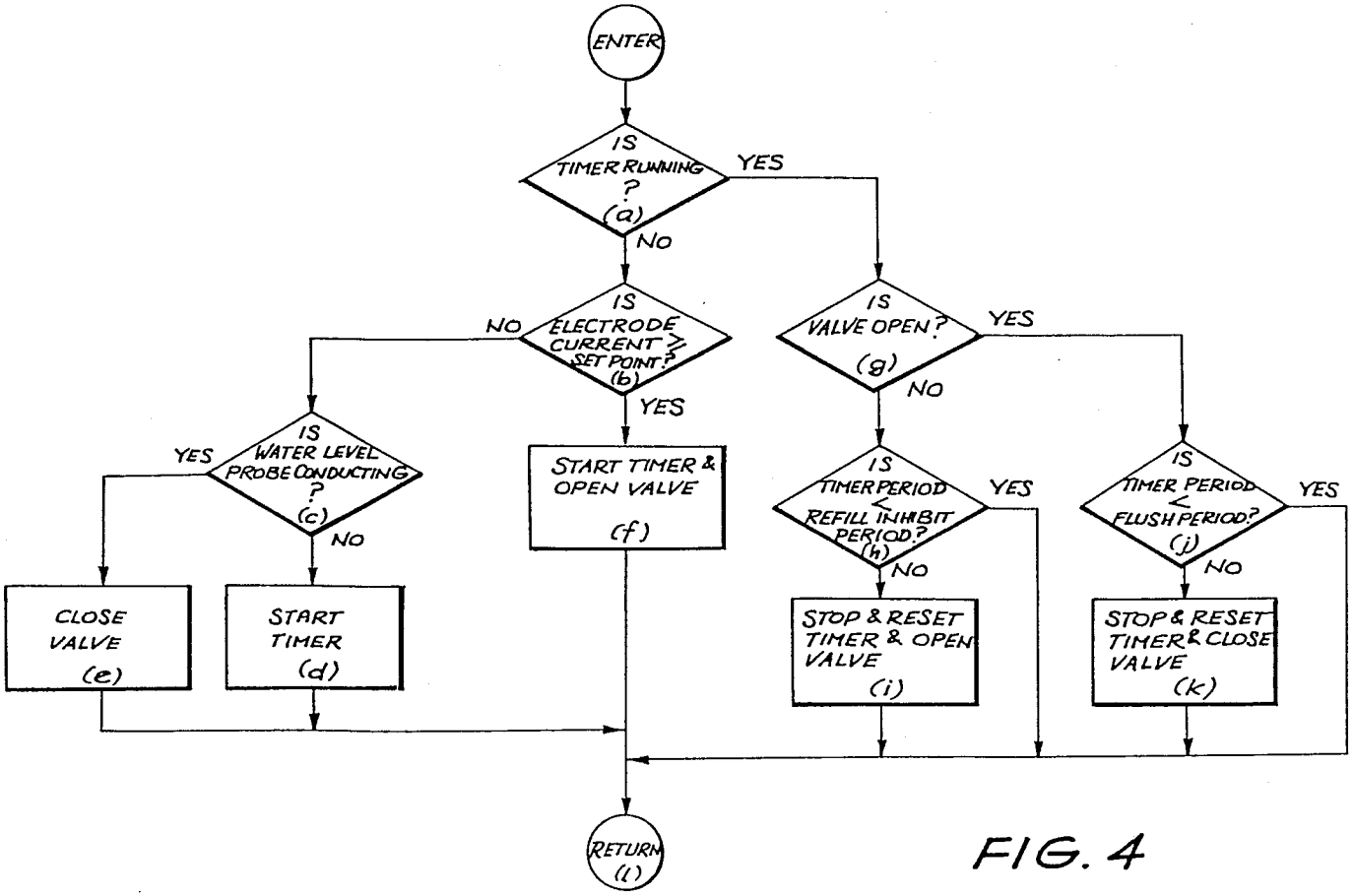

FIG. 3 schmatically illustrates a humidifier wherein flushing is performed in response to the level of impurities in the water, in accordance with the present invention; and FIG. 4 illustrates the flow chart of a program for controlling water level and flushing in the humidifier of FIG. 3 when the control function is provided by a microprocessor.

Figure 1:
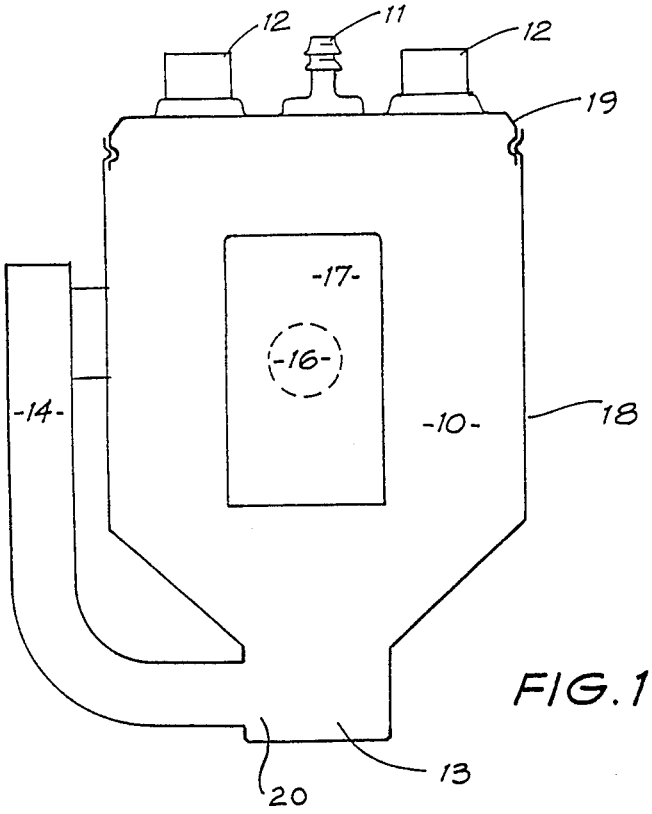
FIG. 1 is a schematic view of a humidifier bottle in accordance with the present invention.
Figure 2:
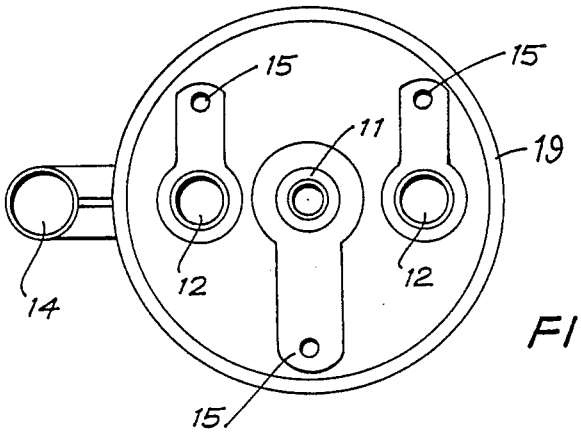
FIG. 2 is a plan view of the bottle of FIG. 1.

Referring to FIGS. 1 and 2, a humidifier bottle in accordance with the present invention is illustrated, comprising a heating chamber 10, a water inlet connection 11, two steam outlet connections 12, a sump or drain 13, a drain outlet 20, a drain pipe 14 and three openings 15 to accommodate connections to a water heater (not shown) located within the heating chamber. In an alternative embodiment, the openings are not provided and in their place an opening 16 is provided in a flat section 17 of the wall of the chamber 10, the opening 16 being adapted to receive a heating element.

The chamber 10 is made in two parts, a body 18 and a removable lid 19, such that access is provided, to internally mounted components by removing the lid portion 19 into which the inlet connection 11, the steam outlets 12 and the openings 15 are moulded.

In use, the bottle of FIGS. 1 and 2 has a maximum water level, under static conditions, which is determined by the height of drain pipe 14. Once the water level in the bottle 10 exceeds the height of the pipe 14, water will run over the end of the pipe until the water level is substantially restored to the level of the pipe. Under actual operating conditions, however, the actual maximum water level will be determined by the presence of steam in the chamber 10 and the rate of flow of water into the chamber.

By providing a humidifier bottle wherein no drain valve is required, and the drain path is separated from the inlet path, larger volumes of water can be flushed through the humidifier in one continuous operation, and impurities carried into the drain will not be returned to the chamber by water entering the chamber. Further, as there is no valve to restrict the drain path, the chance of a blockage occuring is greatly reduced.

The preferred method of heating water in the chamber 10 is by way of electrode immersed in the water, such that an AC voltage applied between the electrodes causes a current to flow in the water. With an electrode heater the steam produced is substantially proportional to the current flowing through the water for a given volume of water and covered electrode area.

As the concentration of impurities in the water increases, so will the electrode current increase, and accordingly, a convenient measure of the impurity level is provided by the level of current flowing through the electrodes.

Referring to FIG. 2, it will be noted that three openings 15 are provided for electrode wiring. These openings are provided for a three phase heater system, wherein three electrodes are used, however it is also possible to provide a single phase heater by using only two electrodes.

The bottle of FIGS. 1 and 2 can also be used as a replacement bottle for humidifiers using element heaters, wherein a resistive element is heated by passing an electric current through it, the element being submerged in the water in the heating chamber to heat the water. Typically, the heating elements in prior art humidifiers, enter the bottle through one side and accordingly the bottle of FIG. 1 is provided with a flat side surface 17 into which an opening 16 can be made to permit the fitting of a heating element. If an element heater is used, then openings 15 in the top of the bottle must be sealed to prevent loss of steam, and the heating element must be provided with a thermostatic cut-out switch to prevent the element from burning out if the heating chamber should be accidentally emptied.

Turning now to FIG. 3, a humidifier is illustrated wherein a three phase system is provided with three electrodes 21 immersed in water 22 contained in a heating chamber 23. Steam produced in the chamber 23 is drawn off via a steam outlet 24 in the lid 25 of the chamber while water in the chamber is replenished by way of an inlet connection 26 also in the lid 25. Water is supplied to the inlet 26 by way of a supply hose 27 and flow is controlled by a water inlet solenoid valve 28. Means for detecting the water level in the chamber is provided by a probe 29 which comprises two electrodes connected to an electrical circuit 35 which detects a current flowing between the electrodes when they are immersed in the water 22. In another embodiment, the probe 29 can be located at the top of the drain pipe 31 in which case the level detection is not affected as greatly by bubbles caused by the boiling water. When a current is not detected between the electrodes of the probe 29 for a predetermined period (nominally 12 seconds), the inlet valve 28 is opened by inlet valve control means 36 to replenish the water in the chamber, and the valve will remain open until a current is once again detected between the electrodes of the water level probe. The probe 29 would normally be set at a level just below the top of the drain pipe such that the water level in the chamber 23 was always maintained below the level where a flow of water out of the drain would begin, thereby minimizing heat lost via water flowing out of the drain.

The water 22 is heated by applying a voltage between the electrodes 21, thereby causing a current to flow through the water. The voltage is provided by a source 32 and can be applied and removed, in accordance with a demand for steam, by closing or opening switches 33 which are preferably of the electrically operated type, such as a relay or solid state switch.

Current flowing between the electrodes 21 is sensed by a sensing circuit 34 and when the current exceeds a preset limit, indicating an upper limit of impurity concentration in the water, the inlet valve 28 is opened by valve control means 36 for a predetermined period to flush the impurities from the heating chamber. By flushing the chamber regularly, in accordance with the actual impurity level, instead of at some arbitrary interval, a more reliable and consistent output is provided by the humidifier.

The monitoring of water level and heater electrode current, and the control of the inlet valve 28 in response to these parameters can be controlled by a dedicated electronic circuit. However, in a preferred embodiment the water level probe and electrode current detection circuits are interfaced to a microprocessor based control unit which monitors these parameters and controls the valve openings in accordance with a control program held in its program memory. One possible set of steps which would enable the processor to control water level and flushing (assuming the existence of either a hardware or software timer in the microprocessor) are as follows:

(a) If the timer is running, go to step (g);
(b) If heating electrode current $\geqq$ set point go to step (f);
(c) If water level probe is conducting go to step (e);
(d) Start timer and go to step (l);
(e) Close inlet valve and go to step (l);
(f) Start timer, open inlet valve and go to step (l);
(g) If valve is open go to step (j);
(h) If timer period $<$ refill inhibit period go to step (l);
(i) Stop and reset timer, open valve and go to step (l);
(j) If timer period $>$ flush period go to step (l)
(k) Stop and reset timer and close inlet valve;
(l) Return to main program.

These steps are illustrated in flow chart form in FIG. 4.

Humidifiers of differing capacities may be provided with only one bottle size, however, it is desirable to reduce the water level in the bottle for lower capacities, in order to keep the heating time within acceptable limits and to reduce the amount of heat loss through the walls of the container. Reducing the water level also has the effect of reducing the rate of steam production for a given supply voltage, by reducing the immersed area of the electrodes, with a corresponding reduction in current flow. As the current flow is reduced, it is also necessary to adjust the current set point at which flushing is commenced and for the best effect, the length of the tube 31 should also be reduced to keep fluctuations in water level to a minimum during flushing.

While the embodiment described makes use of a three phase heating system, the invention is equally applicable to units making use of a single phase or a two phase heater.

It will be recognized by persons skilled in the art that numerous variations and modifications may be made to the invention as described above without departing from the spirit or scope of the invention as broadly described.

I claim:

1. A humidifier comprising:

(a) a heating chamber having side walls, a lid and a bottom defining a closed heating chamber, the bottom extending downwardly from the side walls and defining a single, continuously open drain and flushing outlet located at a lowermost extremity of the bottom so as to allow continuous flushing of impurities from the heating chamber;

(b) a water inlet in fluid communication with the heat chamber;

(c) a steam outlet located near the top of the heating chamber to allow steam to pass outwardly from the heating chamber;

(d) port means defined by the heating chamber;

(e) electric water heating means located in the heating chamber and extending through the port means;

(f) electrical power supply means connected to the water heating means to supply electrical power thereto;

(g) an unobstructed open ended drain pipe having one open end in continuous open fluid communication with the drain and flushing outlet, the drain pipe extending up the outside of the heating chamber a predetermined height so that the other open end of the drain pipe defines a predetermined static water level inside the heating chamber;

(h) a water inlet valve adapted to control the flow of water passing through the water inlet into the heating chamber;

(i) means for detecting the water level in the heating chamber;

(j) inlet valve control means operatively connected to the water level detecting means and to the water inlet valve to open and close the valve to maintain the level of water within the heating chamber approximately equal to the height of the drain pipe; and, (k) flushing control means comprising:

(i) means for detecting the impurity level of the water in the heating chamber; and, (ii) means operatively connecting the inlet valve control means and said impurity level detecting means such that when the impurity level reaches a predetermined level the inlet valve control means opens the water inlet valve for a predetermined period of time to flush accumulated impurities out of the heating chamber through the drain and flushing outlet and the drain pipe.

2. The humidifier of claim 1 wherein the electric water heating means includes a plurality of electrodes extending into the heating chamber and projecting below the water level in the heating chamber to pass a heating current therethrough.

3. The humidifier of claim 2 wherein the electrical power supply means supplies alternating current.

4. The humidifier of claim 3 wherein the electric water heating means is operable from a three-phase power supply means and comprises three electrodes projecting below the water level in the chamber.

5. The humidifier of claim 4 wherein the water level detection means associated with said heating chamber includes means for generating a signal when the water level in the heating chamber is equal to or greater than said predetermined high water level.

6. The humidifier of claim 5 wherein the inlet valve control means includes means for opening the inlet valve in response to the water level, as detected by the water level detection means, remaining below the predetermined high water level for a period of time that exceeds a fixed predetermined period.

7. The humidifier of claim 6 wherein the means for detecting the impurity level comprises means for measuring the current flowing in one of the electrodes and comparator means for generating the flushing signal when the measured electrode current reaches a predetermined level.

* * * * *